US008657407B2

(12) United States Patent
Kyotani

(10) Patent No.: US 8,657,407 B2
(45) Date of Patent: Feb. 25, 2014

(54) LIQUID EJECTING DEVICE

(71) Applicant: Brother Kogyo Kabushiki Kaisha, Nagoya (JP)

(72) Inventor: Tadao Kyotani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/629,530

(22) Filed: Sep. 27, 2012

(65) Prior Publication Data

US 2013/0106940 A1 May 2, 2013

(30) Foreign Application Priority Data

Oct. 31, 2011 (JP) ..... 2011-238628

(51) Int. Cl.
*B41J 2/165* (2006.01)

(52) U.S. Cl.
USPC ..... 347/30; 347/29; 347/34

(58) Field of Classification Search
USPC ..... 347/5, 9, 29, 30, 34
See application file for complete search history.

(56) References Cited

U.S. PATENT DOCUMENTS

| | | | | |
|---|---|---|---|---|
| 8,152,266 | B2 * | 4/2012 | Sekiya et al. | 347/30 |
| 2007/0206047 | A1 | 9/2007 | Matsuda | |
| 2007/0229584 | A1 * | 10/2007 | Hirato | 347/30 |

FOREIGN PATENT DOCUMENTS

| | | | |
|---|---|---|---|
| JP | 2007-230137 | A | 9/2007 |
| JP | 2009-101594 | A | 5/2009 |
| JP | 2010-076161 | A | 4/2010 |

* cited by examiner

*Primary Examiner* — Lam S Nguyen
(74) *Attorney, Agent, or Firm* — Baker Botts L.L.P.

(57) ABSTRACT

A liquid ejecting device including a liquid ejecting head having an ejection surface, a liquid receiving member having a liquid receiving surface, an annular member for sealing an ejection surface, a positional relationship adjusting unit for adjusting a positional relationship between the ejection surface and the liquid receiving surface, an air inlet, a humidified air supplying unit, a cleaning unit, a viscosity information obtainment unit, and a control unit is provided. The control unit conducts a liquid receiving surface cleaning action including control of the positional relationship adjusting unit for adjusting the positional relationship between the ejection surface and the liquid receiving surface to form a first positional relationship, the humidified air supplying unit for supplying humidified air to the ejection space, and the cleaning unit for removing the liquid received on the liquid receiving surface.

9 Claims, 10 Drawing Sheets

LIQUID EJECTING DEVICE

CROSS REFERENCE TO RELATED APPLICATION

This application claims priority from Japanese Patent Application No. 2011-238628, filed on Oct. 31, 2011, the entire subject matter of which is incorporated herein by reference.

BACKGROUND

1. Technical Field

An aspect of the present invention relates to a liquid ejecting device, which is capable of ejecting liquid.

2. Related Art

A liquid ejecting device to eject ink from ejecting openings (e.g., nozzles) formed on an ejecting surface of a liquid ejecting head is known. In order to avoid desiccation of the liquid remaining in the nozzles, a method to separate an ejection space, to which the ejecting surface is exposed, from an outer space, may be suggested. For example, the nozzle surface and the ejection space may be sealed from the outer space by a nozzle cover.

With the nozzle cover, the liquid ejected from the nozzles may be received on a liquid receiver (i.e., the nozzle cover). The liquid remaining on the liquid receiver may be condensed due to desiccation over time When the ejection space is sealed and isolated from the outer space, with the condensed liquid, some component in the remaining liquid may serve as dehydrating agent to dehumidify the air in the ejecting space. As a result, the liquid remaining in nozzles may be dehydrated. Therefore, it is necessary that the liquid remaining on the liquid receiver is periodically removed For example, an inkjet recording apparatus being a liquid ejecting device may have a wiper unit with a wiper blade. The wiper blade may scrape the bottom of the nozzle cover to wipe off the ink remaining on the bottom of the nozzle cover and direct the scraped ink to a discharge port. Thus, the ink remaining on an ink receiver (i.e., the nozzle cover) may be removed.

SUMMARY

However, in the wiper unit in the inkjet recording apparatus, a form of the ink receiver having a cap, which is to contact the ejecting surface, may be complicated, and removing the remaining ink to clean the ink receiver may be difficult. Further although the wiper blade may scrape the liquid off from the bottom of the cap, when the dehydrated condensed liquid may adhere to the bottom of the cap, it may be difficult to remove the thickened liquid by the wiper blade alone.

An aspect of the present invention may be advantageous in that a liquid ejecting device, in which adhesive liquid may be removed from the liquid receiver, and in which the ejection space surrounding the ejecting surface may be prevented from desiccation, is provided.

According to an aspect of the invention, a liquid ejecting device is provided. The liquid ejecting device includes a liquid ejecting head including an ejection surface on which an ejection opening for ejecting liquid is formed, a liquid receiving member including a liquid receiving surface on which the liquid ejected from the ejection opening is received, an annular member arranged around the liquid ejecting head and configured to seal an ejection space to which the ejection surface is opposed from an outer space the liquid receiving surface, a positional relationship adjusting unit configured to adjust a positional relationship between the ejection surface and the liquid receiving surface by moving at least one of the liquid ejecting head and the liquid receiving member to form one of a first positional relationship in which the annular member is able to contact the liquid receiving member to seal the ejection space from the outer space and a second positional relationship in which the liquid, receiving surface and the ejection surface are separated farther from each other than the liquid receiving surface and the ejection surface in the first positional relationship, an air inlet communicated with the ejection space, a humidified air supplying unit configured to supply humidified air to the ejection space through the air inlet, a cleaning unit configured to clean the liquid receiving surface by removing the liquid received on the liquid receiving surface, a viscosity information obtainment unit configured to obtain information concerning viscosity of the liquid received on the liquid receiving surface, and a control unit configured to conduct a liquid receiving surface cleaning action, when the information concerning viscosity of the liquid obtained by the viscosity information obtainment unit indicates at least a predetermined degree of viscosity. The liquid receiving surface cleaning action includes controlling the positional relationship adjusting unit so as to adjust the positional relationship between the ejection surface and the liquid receiving surface to form the first positional relationship, controlling the humidified air supplying unit so as to supply the humidified air to the ejection space for a predetermined time, and controlling the cleaning unit so as to remove the liquid received on the liquid receiving surface.

BRIEF DESCRIPTION OF THE ACCOMPANYING DRAWINGS

Figure 3A:
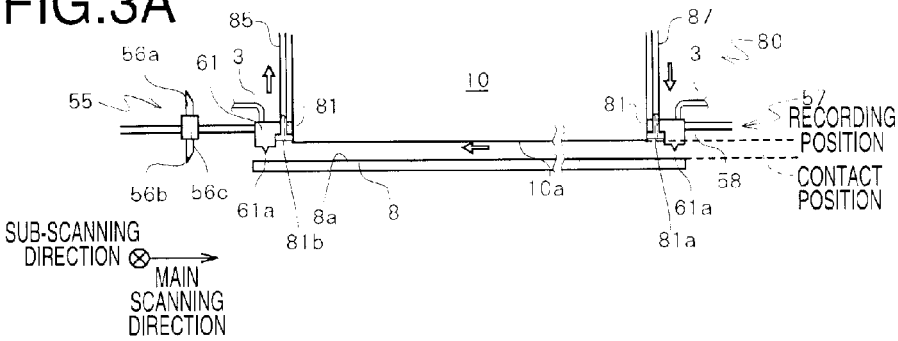
Figure 3B:
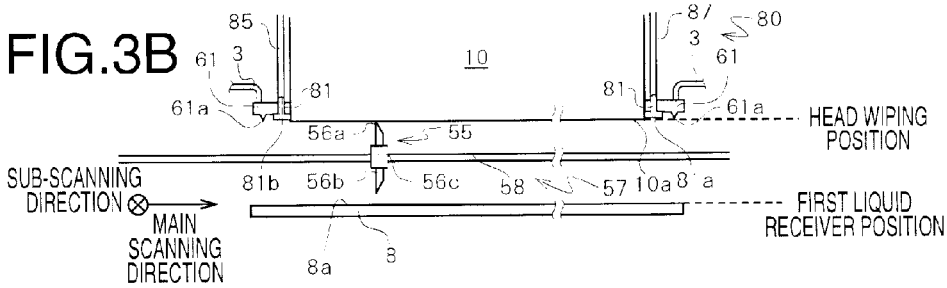
Figure 3C:
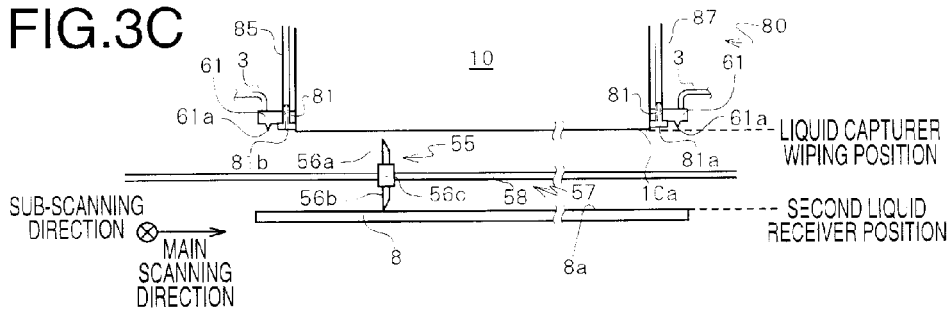
Figure 3D:
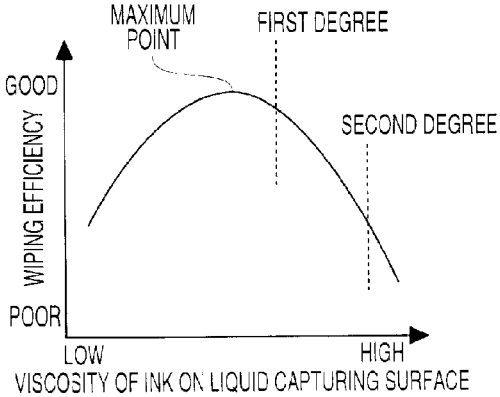

FIG. 3A illustrates behaviors of a wiper unit and the liquid receiver in a liquid receiver cleaning action in the inkjet printer according to the embodiment of the present invention. FIG. 3B illustrates behaviors of the wiper unit and the liquid receiver in a head wiping action in the inkjet printer according to the embodiment of the present invention. FIG. 3C illustrates behaviors of the wiper unit and the liquid receiver in a liquid receiver wiping action in the inkjet printer according to the embodiment of the present invention. FIG. 3D illustrates a characteristic of wiping efficiency of the ink to be wiped in the liquid receiver wiping action in the inkjet printer according to the embodiment of the present invention.

Figure 4:
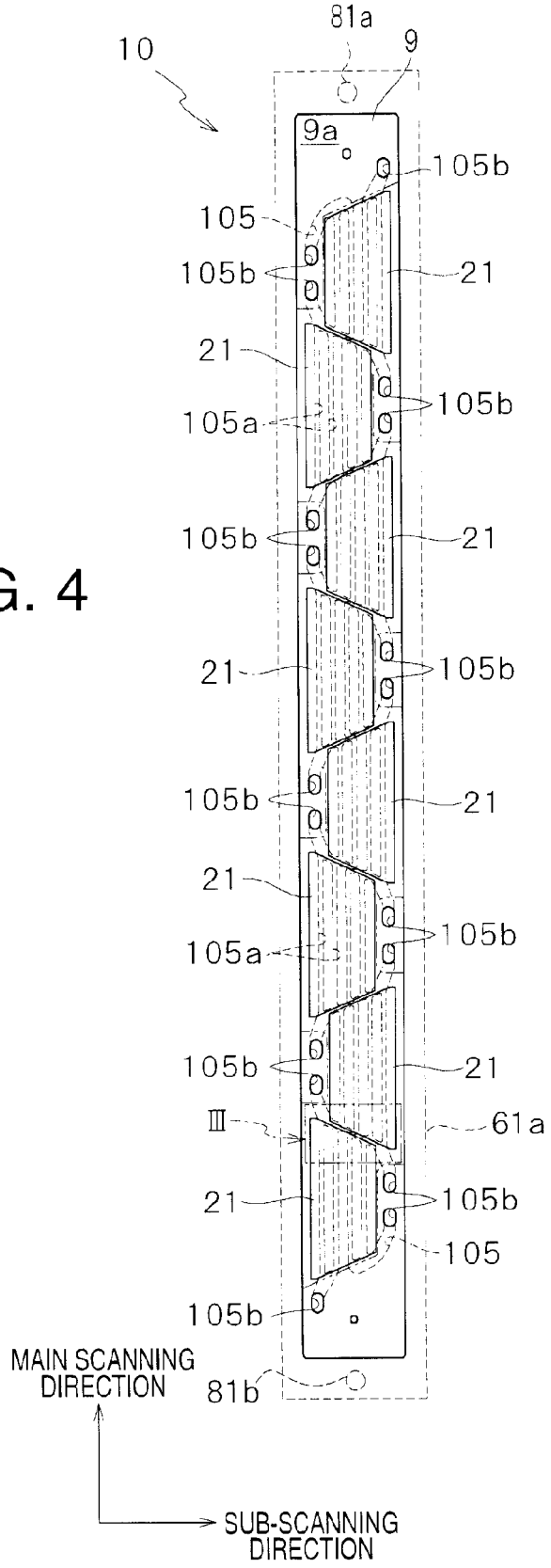

FIG. 4 is a plane view of an inkjet head having a flow channel unit and an actuator unit in the inkjet printer 1 according to the embodiment of the present invention.

Figure 5A:
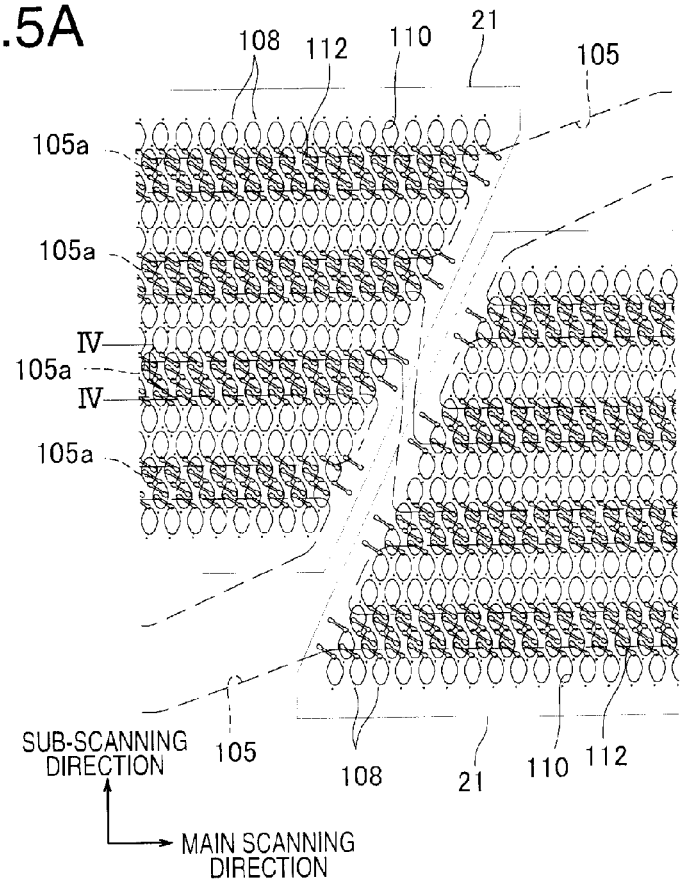
Figure 5B:
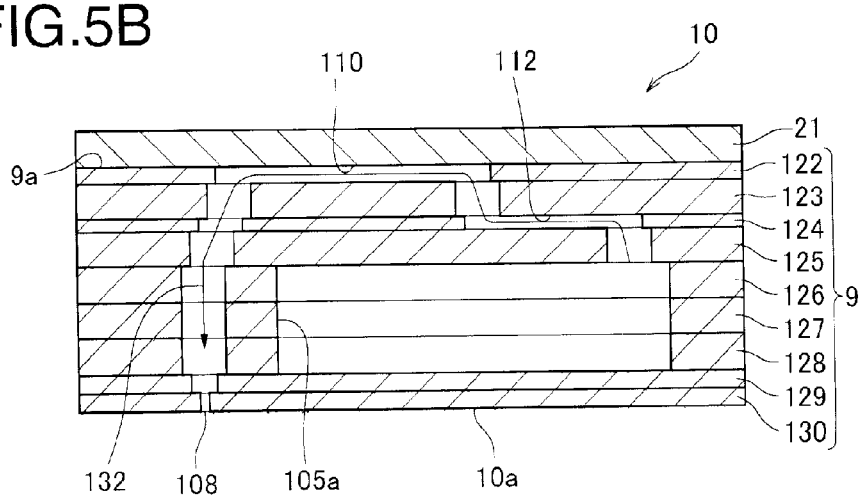

FIG. 5A is an enlarged view of an area III in a dashed line shown in FIG. 4 in the inkjet head of the inkjet printer according to the embodiment of the present invention, FIG. 5B is a cross-sectional view of the inkjet head taken along, a line IV-IV shown in FIG. 5A.

Figure 6:
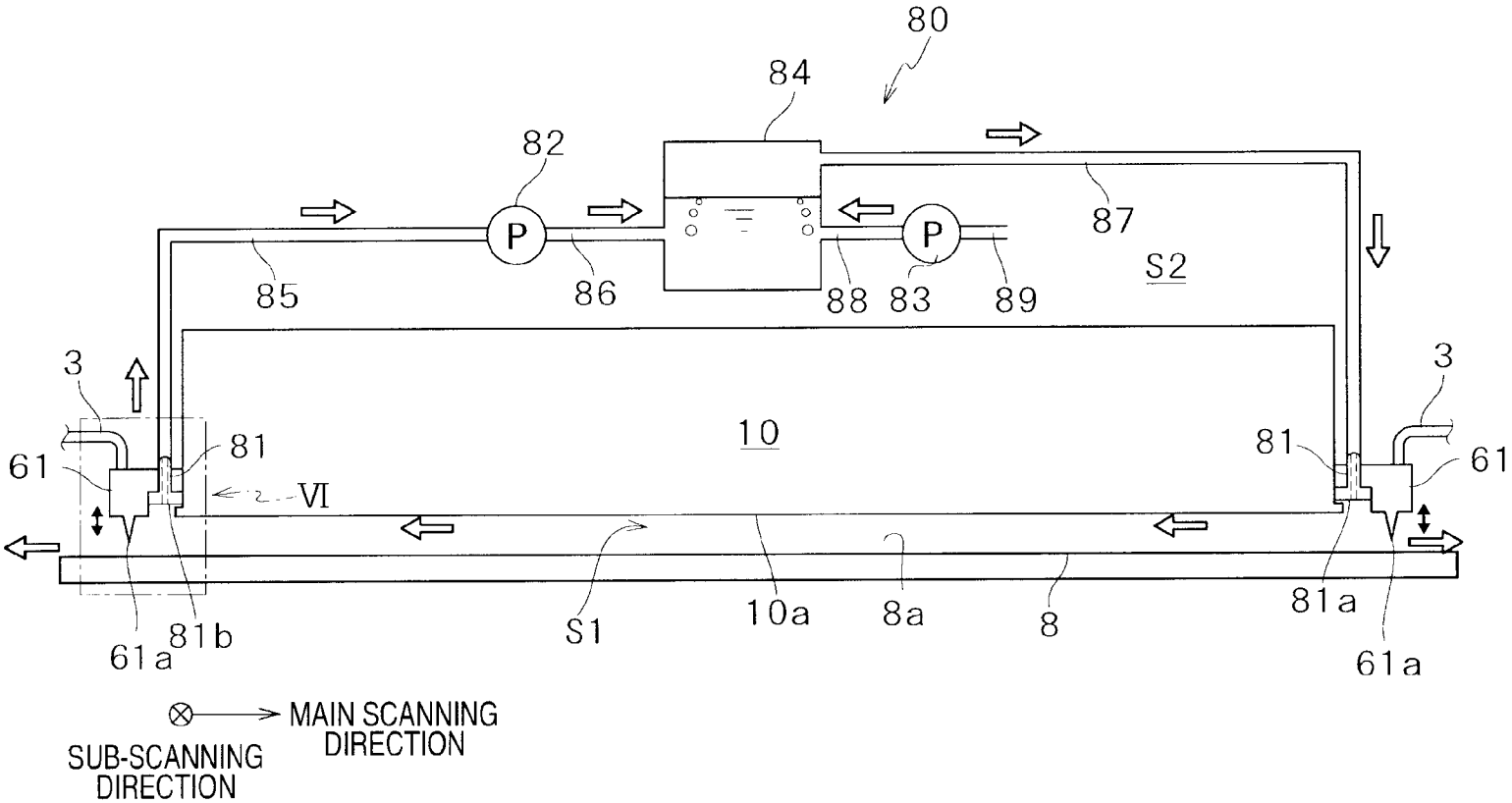

FIG. 6 is a schematic view of a humidified air supplying unit in the inkjet printer according to the embodiment of the present invention.

Figure 7B:
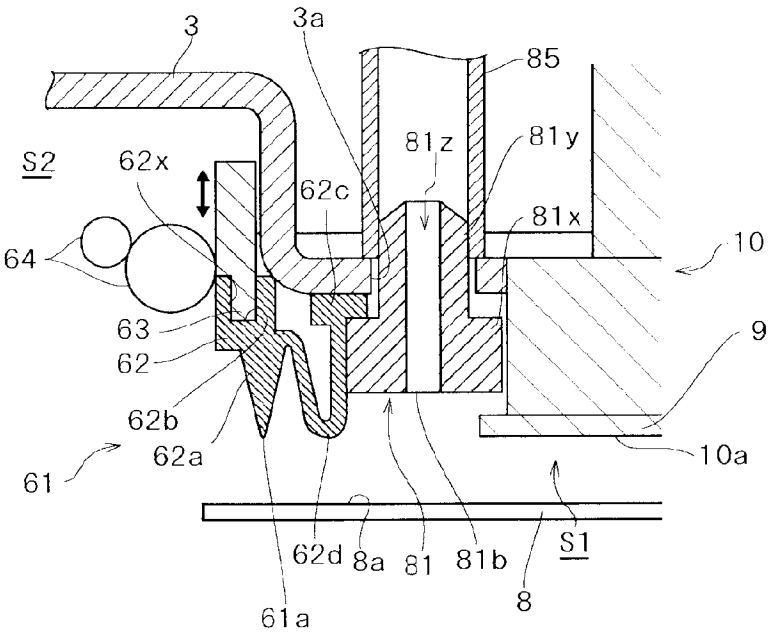
Figure 7A:
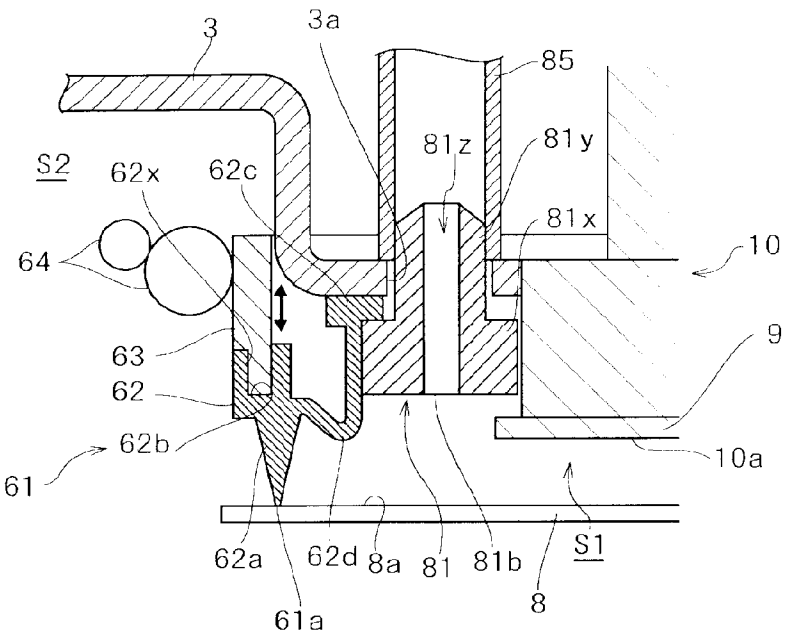

FIGS. 7A and 7B are cross-sectional partial views of an area VI in a dashed line shown in FIG. 6 in the inkjet printer according to the embodiment of the present invention.

Figure 8:
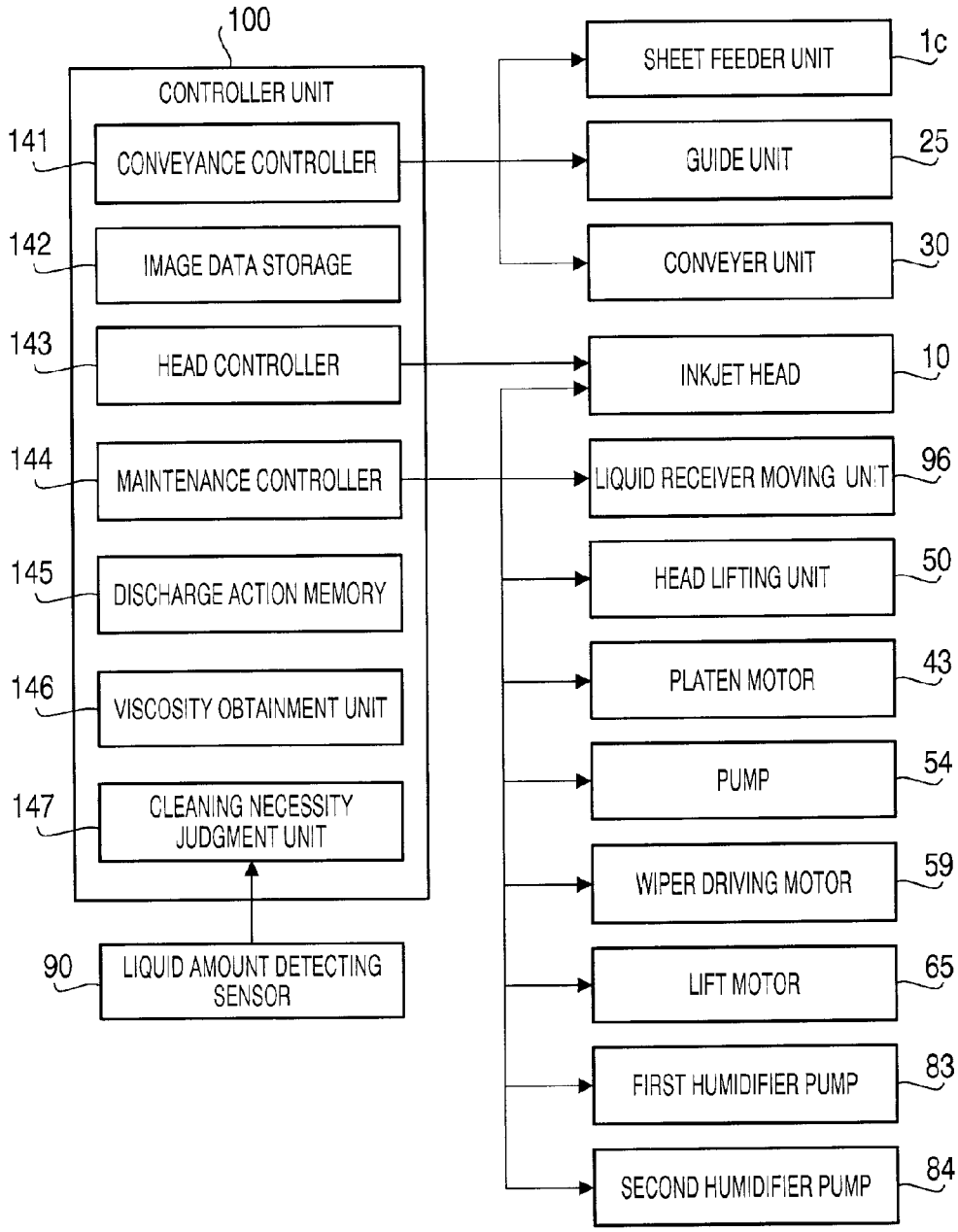

FIG. 8 is a block diagram to illustrate an electrical configuration of a control unit in the inkjet printer according to the embodiment of the present invention.

Figure 9:
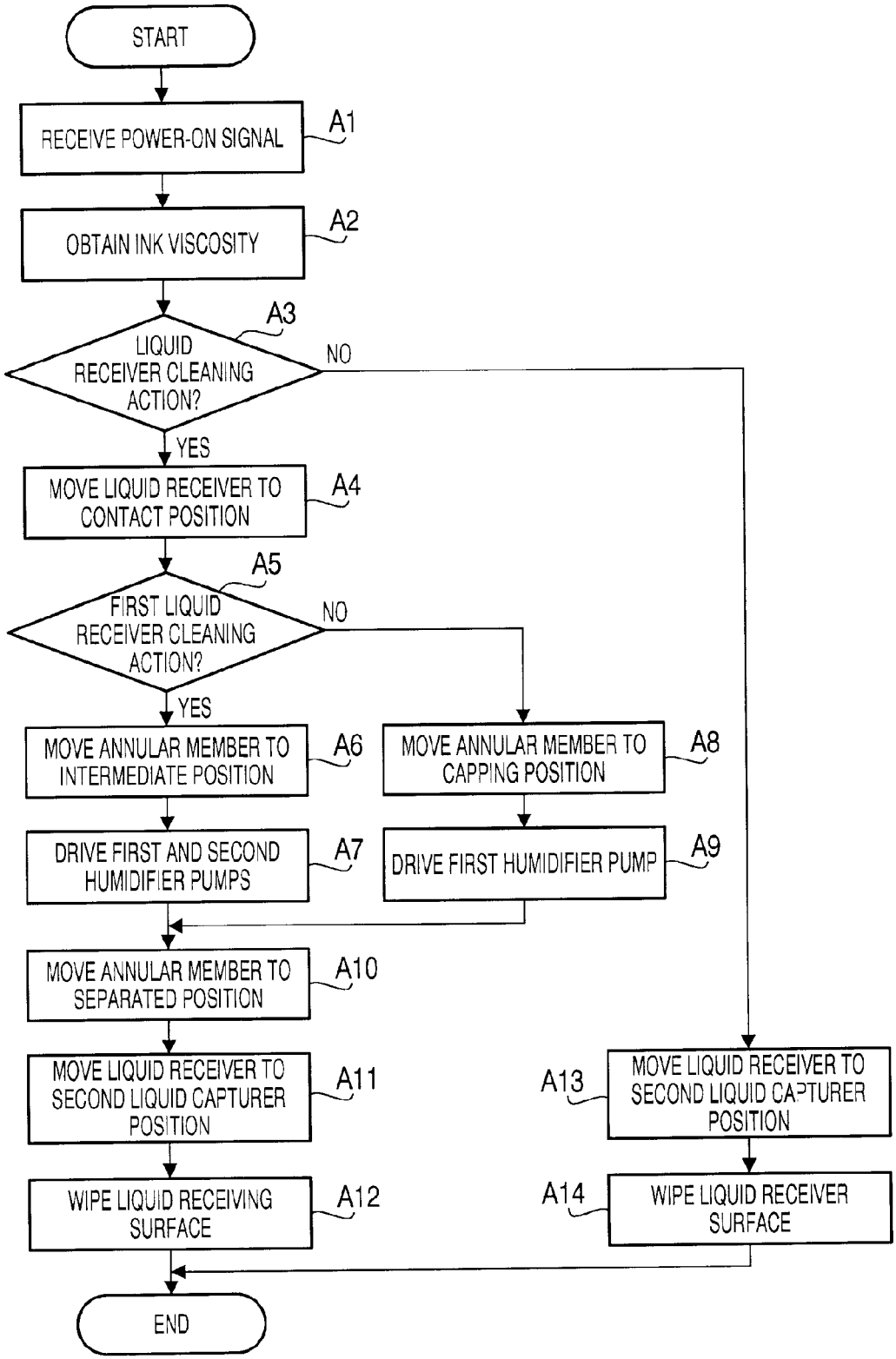

FIG. 9 is a flowchart to illustrate steps in the liquid receiver cleaning action for the control unit in the inkjet printer according to the embodiment of the present invention.

Figure 10:
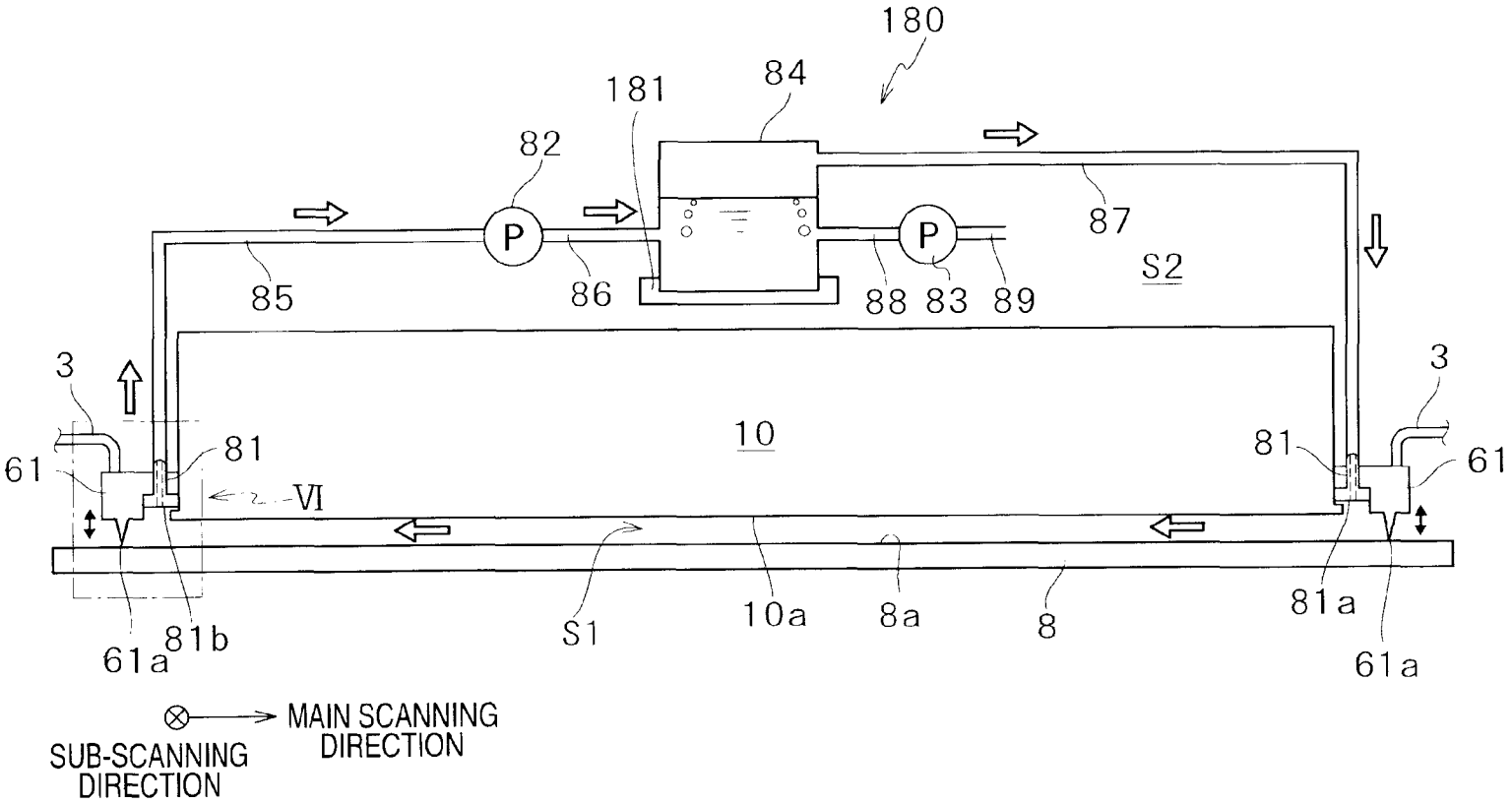

FIG. 10 is another exemplary schematic view of a humidified air supplying unit in the inkjet printer according to the embodiment of the present invention.

DETAILED DESCRIPTION

Hereinafter, an inkjet printer 1 as an embodiment of the liquid ejecting device according to the invention will be described with reference to the accompanying drawings.

Figure 1:
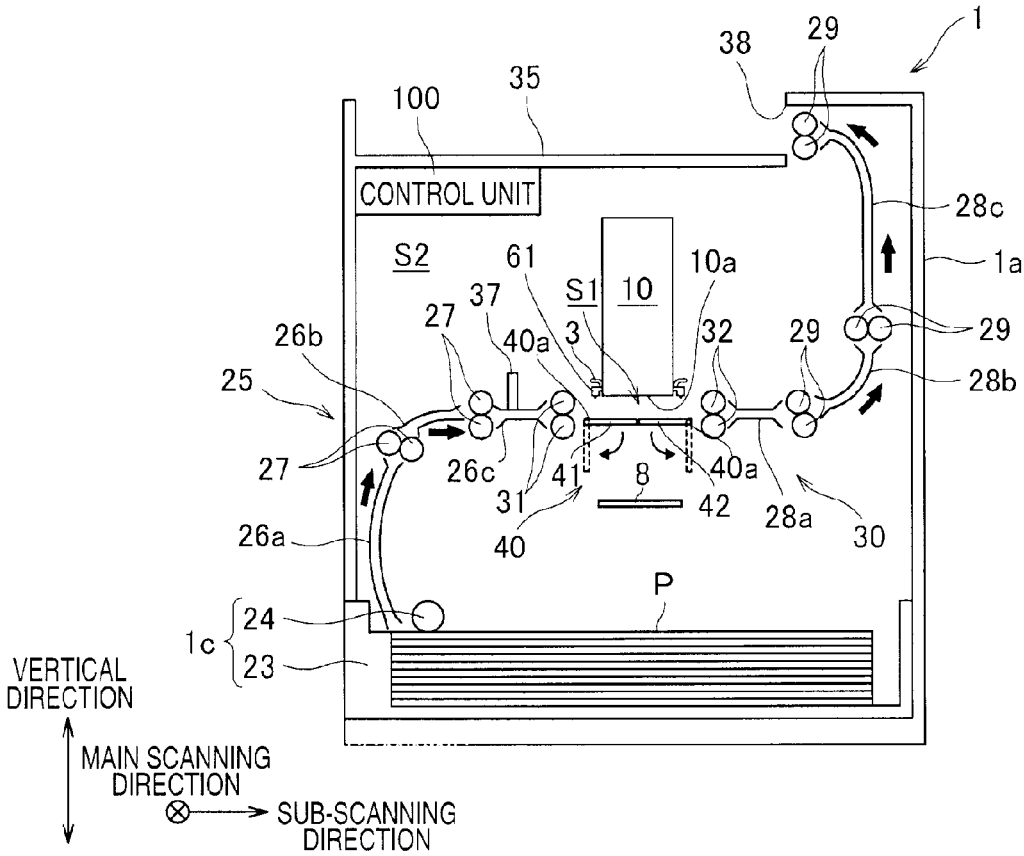
FIG. 1 is a schematic side view of an inkjet printer according to an embodiment of the present invention.

Firstly, an overall configuration of the inkjet printer 1 will be described with reference to FIG. 1. The inkjet printer 1 has a chassis 1*a*, which is formed in a shape of a rectangular box. On top of the chassis 1*a*, a discharge section 35 is provided, in a space enclosed by the chassis 1*a*, a sheet conveyer path is formed. In the sheet conveyer path, sheets P being recording media are conveyed from a feeder unit 1*c* to the discharge section 35. A flow of the sheet P being conveyed in the sheet conveyer path is indicated by thick arrows shown in FIG. 1.

The chassis 1*a* accommodates an inkjet head 10, a conveyer unit 30, a platen 40, a guide unit 25, a cartridge (not shown), a head lifting unit 50 (see FIG. 8), a wiper unit 55 (see FIG. 3), a liquid, receiver 8, an annular member 61, a humidified air supplying unit 80 (see FIG. 6), a liquid receiver moving unit 96 (see FIG. 8), and a controller unit 100. The conveyer unit 30 conveys the sheet P in the sheet conveyer path. The platen 40 supports the sheet P in a position opposite from an ejection surface 10*a* of the inkjet head 10 to face the ejection surface 10*a* when an image is recorded on the sheet P. The guide unit 25 guides the sheet P being conveyed. The cartridge reserves ink to be supplied to the inkjet head 10. The cartridge is connected to the inkjet head 10 via a tube (not shown) and a pump 54 (see FIG. 8). The liquid receiver 8 captures the ink ejected from the inkjet head 10. The controller unit 100 controls behaviors of the units installed in the inkjet printer 1.

The inkjet head 10 is a line head, which is formed in a shape of an elongated bar extending along a main scanning direction. A bottom surface of the inkjet head 10 is provided as the ejection surface 10*a*, on which a plurality of nozzles 108 (see FIG. 5) being ejecting openings are formed. When the image is recorded on the sheet P, the ink is ejected through the nozzles 108 toward the sheet P.

The inkjet head 10 is supported by the chassis 1*a* via a head holder 3. In particular, the head holder 3 holds the inkjet head 10 in a position to maintain a predetermined amount of clearance between the ejection surface 10*a* and an upper plane of the platen 40. The head holder 3 and the inkjet head 10 will be described more in detail later.

The conveyer unit 30 includes a conveyer nip rollers 31, 32, which are arranged respectively on an upstream side and a downstream side with respect to the platen 40 along the flow of the sheet being conveyed, i.e., in a sheet conveying direction. Each of the conveyer nip rollers 31, 32 includes a pair of rollers, which are arranged to vertically face each other across the sheet conveyer path. When the sheet P is in a nipped position between the paired rollers in the conveyer nip rollers 31 in the upstream position, as the paired conveyer nip rollers 31 rotate, conveying force is applied to the sheet P by the conveyer nip rollers 31. Accordingly, the sheet P is conveyed in the sheet conveying direction and over the platen 40 whilst the platen 40 supports the sheet P. When the sheet P passes over the platen 40 and comes to a nipped position between the paired rollers in the conveyer nip rollers 32 in the downstream position, as the paired conveyer rollers 32 rotate, conveying force is applied, to the sheet P by the conveyer nip rollers 32. Accordingly, the sheet P is conveyed further downstream beyond the platen 40 in the sheet conveying direction.

The platen 40 includes a pair of clamshell-openable doors 41, 42, which are rotatably supported by rotation shafts 40*a*, 40*a* respectively. The rotation shafts 40*a* are arranged on an upstream side and a downstream side with respect to the ejection surface 10*a*, in a top plane view, and extend in parallel with the ejection surface 10*a* along the main scanning direction. By having the doors 41, 42 rotated about the rotation shafts 40*a* with driving force from a platen motor 43 (see FIG. 8), the platen 40 can be selectively placed in a facing position (see FIG. 2A), in which the doors 41, 42 align horizontally to face the ejection surface 10*a*, or an open position (see FIGS. 2B and 2C), in which the doors 41, 12 do not face the ejection surface 10*a* but droop from the rotation shafts 40*a*. When the platen 40 is in the facing position, an amount of the clearance between the ejection surface 10*a* and the top surface of the platen 40 is smaller than clearance between the ejection surface 10*a* and a top surface of the liquid receiver 8. When the platen 40 is in the facing position, further, the top surface of the platen 40 to face the ejection surface 10*a* supports the sheet P. Therefore, the top surface of the platen 40 may be formed to have specific forms or made of a specific material to hold the sheet P. For example, the top surface may have a silicon layer made of a mildly adhesive material. For another example, the top surface may be formed to have ribs extending along the sheet conveying direction. Such designs to support the sheet P may prevent the sheet P from floating away from the top surface of the platen 40. The platen 40 may be formed in a resin.

The guide unit 25 includes an upstream guide and a downstream guide, which are arranged on an upstream side and a downstream side with respect to the conveyer unit 30. The upstream guide includes three (3) guides 26*a*, 26*b*, 26*c* and two (2) pairs of rollers 27, 27. The upstream guide links the feeder unit 1*c* with the conveyer unit 30. The downstream guide includes three (3) guides 28*a*, 28*b*, 28*c* and three (3) pairs of rollers 29, 29, 29. The downstream guide links the conveyer unit 30 with the discharge section 35.

The feeder unit 1*c* includes a feeder tray 23 and a feed roller 24. The feeder tray 23 is movable with respect to the chassis 1*a* in a sub-scanning direction to be attached to and removed from the chassis 1*a*. The feeder tray 23 is a flat box, which is open upwardly, and is capable of storing the sheets P therein. The feed roller 24 is rotatable under control of the control unit 100, and as the feed roller 24 rotates, an uppermost sheet P in the sheets P stored in the feeder tray 23 is picked up and fed in the sheet feeding path. The sub-scanning direction refers to a direction extending in parallel with the conveying direction of the sheet P conveyed by the conveyer unit 30 (i.e., horizontal direction in FIG. 1), and the main scanning direction extends in parallel with the horizontal plane in FIG. 1 and orthogonal to the sub-scanning direction.

The control unit 100 controls behaviors of each unit in the inkjet printer 1 and operations executed in the inkjet printer 1. In particular, the control unit 100 conducts an image recording operation based on a recording instruction, which is inputted from an external device (e.g., a PC connected with the inkjet printer 1). For example, the control unit 100 controls a sheet conveying action to convey the sheet P and ink ejecting action to eject ink toward the sheet P in synchronization with the sheet conveying action. The sheet P fed from the feeder tray 23 is guided by the guides 26*a*, 26*b*, 26*c* and nipped by the rollers 27 to be forwarded to the conveyer unit 30. The conveyer unit 30 conveys the sheet P to a position between the inkjet head 10 and the platen 40. As the sheet P passes through the position underneath the inkjet head 10 along the sub-scanning direction, ink is ejected from the nozzles 108, and an image is formed on the sheet P in the ink. Ejection of the ink from the nozzles 108 is conducted by the control unit 100 based on signals detected by a sheet sensor 37. The sheet P is thereafter guided by the guides 28*a*, 28*b*, 28*c* and the rollers 29 to be conveyed upwardly and discharged out of the chassis 1*a* in the discharge section 35 through an outlet 38 formed in an upper position in the chassis 1*a*.

The control unit 100 can control maintenance actions, which are conducted to maintain and regain ink ejecting quality of the inkjet head 10. The maintenance actions include a regular humidifying action, a discharging action, a wiping action, and a liquid receiver cleaning action.

The regular humidifying action is conducted to supply humid air into an enclosed ejection space S1, which is separated from outer space S2. The ejection space S1 is an area, to which the ejection surface 10*a* opposes, and which is enclosed by the annular member 61, the liquid receiver 8, and the ejection surface 10*a* when the liquid receiver 8 is in contact with a tip 61*a* of the annular member 61. In other words, the ejection surface 10*a* of the inkjet head 10 is exposed to the ejection space S1. The structure of the annular member 61 with the tip 61*a* will be described later in detail. The regular humidifying action may be conducted, for example, when the inkjet printer 1 is not recording an image or when the inkjet printer is in a standby state.

The discharging action includes flushing and purging. In the flushing action, actuators (not shown) of the inkjet head 10 are driven based on flushing data, which is different from image data, in order for the ink to be ejected from some or all of the nozzles 108 so that the ink remaining in the nozzles 108 is forcibly removed from the nozzles 108. In the purging action, pressure is applied by the pump 54 (see FIG. 8) to the ink in the inkjet head 10 so that the remaining ink is forcibly removed from all of the nozzles 108.

The wiping action includes ahead-wiping, action and a liquid receiver wiping action. In the head-wiping action, ink adhered to the ejection surface 10*a* of the inkjet head 10 is removed. In the liquid receiver wiping action, ink adhered to a liquid receiving surface 8*a* is removed. The wiping action may be conducted, for example, after conducting the discharging action.

The liquid receiver cleaning action includes the liquid receiver wiping, action conducted after supplying the humid air in the ejection space S1 for a predetermined period. The liquid receiver cleaning action includes a first liquid receiver cleaning action, in which humid air is supplied in the enclosed ejection space S1 (see FIG. 10), and a second liquid receiver cleaning action, in which horrid air is supplied in the ejection space S1, which is not isolated from the outer space S2.

FIG. 3D shows a characteristic of wiping efficiency of the ink adhered to the liquid receiving surface 8*c*, which can be wiped by the liquid receiver wiping action, in consideration of viscosity of the ink. As shown in FIG. 3D, the characteristic is represented in an upward curve with a maximum point. With this characteristic, when a large amount of ink with higher viscosity than the maximum point adheres to the liquid receiving surface 8*a*, a large part of the adhered ink may remain even without being removed after the liquid receiver wiping action. Therefore, when an amount of the ink adhered to the liquid receiving surface 8*a* is larger than a predetermined amount, and when a degree of viscosity of the adhered ink is higher than a first degree of viscosity, the first liquid receiver cleaning action is conducted.

Even when an amount of ink adhered to the liquid receiving surface 8*a* is smaller, if the ink coagulates to the liquid receiving surface 8*a* tightly, the ink may not be removed by the liquid receiver wiping action. Therefore, even when the amount of ink adhered to the liquid receiving surface 8*a* is smaller, if the degree of viscosity of the ink is higher than a second degree, the second liquid receiver cleaning action is conducted. In the present embodiment, the second degree of viscosity is larger than the first degree of viscosity (see FIG. 3D).

The wiper unit 55 includes, as shown in FIGS. 3A-3C, an ejection surface wiper 56*a*, a liquid receiver wiper 56*b*, abuse 56*c* to hold the wipers 56*a*, 56*b*, and a wiper moving system 57. The ejection surface wiper 56*a* is a thin piece of resilient member, such as rubber, and is formed to be larger in length along the sub-scanning direction than a length of the ejection surface 10*a* along the sub-scanning direction. Similarly, the liquid receiver wiper 56*b* is a thin piece of resilient member and is formed to be larger in length along the sub-scanning direction than a length of the liquid receiving surface 8*a* of the liquid receiver 8. The base 56*c* is formed to have a shape of a bar extending in the sub-scanning direction. In each longitudinal end position in the base 56*e*, a through-hole is formed to penetrate the base 56*c* along the main scanning direction. An inner surface of one of the through-holes is threaded to provide a female screw. The wiper moving system 57 includes two guides 58 aligned with the sub-scanning direction, and a wiper driving motor 59 (see FIG. 8), which applies rotating force to one of the two guides 58. The guides 58 are round bars arranged in upstream positions with respect to the inkjet head 10 along the sheet conveying direction to extend in parallel with the main scanning direction. An outer peripheral surface of one of the guides 58, to which the rotating force is applied from the wiper driving motor 59, is threaded to form a male screw. The threaded guide 58 is inserted in the one of the through-holes with the female screw to be engaged with the female screw. The other one of the guides 58 is a plain round bar, of which outer peripheral surface is not threaded but smooth. The other of the guides 58 with the plain peripheral surface is inserted in the other one of the through-holes with no female screw in the base 56*c*.

As the wiper driving motor 59 rotates, the guide 58 with the male screw rotates, and the base 56*c* moves along the guide 58 in the main scanning direction. In this regard, the guide 58 with no screw prevents the base 56*c* from being rotated along with the guide 58 having the male screw. A position in the vicinity of a leftward end of the inkjet head 10 (see FIG. 3A) in the main scanning direction is a standby position for the base 56*c*. With the wiper unit 55, in the head-wiping action, the ejection surface wiper 56*a* being in contact with the ejection surface 10*a* moves in parallel with the ejection surface 10*a* to scrape the ink adhered to the ejection surface 10*a* by the ejection surface wiper 56*a*. In the liquid receiver wiping action, the liquid receiver wiper 56*b* being in contact with the liquid receiving surface 8*a* moves in parallel with the liquid receiving surface 8*a* a to scrape the ink adhered to the liquid receiving surface 8*a* by the liquid receiver wiper 56*b*.

The head lifting unit 50 is configured to move the inkjet head 10 to one of a recording position, a head wiping position, and a liquid receiver wiping position selectively by uplifting and lowering the head holder 3 vertically. In the recording position, the inkjet head 10 faces the platen 40 with a predetermined recording-suitable amount of clearance maintained in there-between (see FIG. 1). The head wiping position is a position higher than the recording position, and in which the inkjet head 10 is placed during the head wiping action (see FIG. 3B). The liquid receiver wiping position is a position higher than the head wiping position, and in which the inkjet head 10 is placed during the liquid receiver wiping action (see FIG. 3C).

When the inkjet head 10 is placed in the head wiping position, as shown in FIG. 3B, the ejection surface 10*a* is in a position slightly lower than a level of an upper end of the ejection surface wiper 56*a*. When the inkjet head 10 is placed in the liquid receiver wiping position, as shown in FIG. 3C, the ejection surface 10*a* is in a position higher than the level of the upper end of the ejection surface wiper 56*a*.

The liquid receiver 8 is a thin piece of glass formed to have a rectangular plane, which is substantially larger than an outline of the annular member 61. The liquid receiver 8 provides an upper surface thereof as the liquid receiving surface 8*a*, on which the ink ejected from the nozzles 108 is captured. The material for the liquid receiver 8 is not necessarily limited to glass but may be replaced with other material. In the chassis 1*a*, a liquid amount detecting sensor 90 (see FIG. 8), which is an optical sensor to detect an amount of the ink adhered to the liquid receiving surface 8*a*, is arranged.

The liquid receiver moving unit 96 uplifts and lowers the liquid receiver 8 under control of the control unit 100 and adjusts positions of the ejection surface 10*a* and the liquid receiving surface 8*a* with respect to each other. In particular, the liquid receiver moving unit 96 moves the liquid receiver 8 to one of a contact position, an initial position, a first liquid receiving position, and a second liquid receiving position selectively.

The contact position for the liquid receiver 8 is a position (see FIGS. 2B and 3A), in which the liquid receiving surface 8*a* faces the ejection surface 10*a* of the inkjet head 10, and in which the tip 61*a* of the annular member 61 contacts the liquid receiving surface 8*a* when, with the inkjet head 10 is in the recording position, a movable member 63 (see FIGS. 7A, 7B) is lowered, and the ejection space S1 is sealed from the outer space S2. When the liquid receiver 8 is placed in the contact position, the positional relationship between the ejection surface 10*a* of the inkjet head 10 being in the recording position and the liquid receiving surface 8*a* will be referred to as a first positional relationship. The flushing action is conducted when the liquid receiver 8 is in the contact position.

Figure 2A:
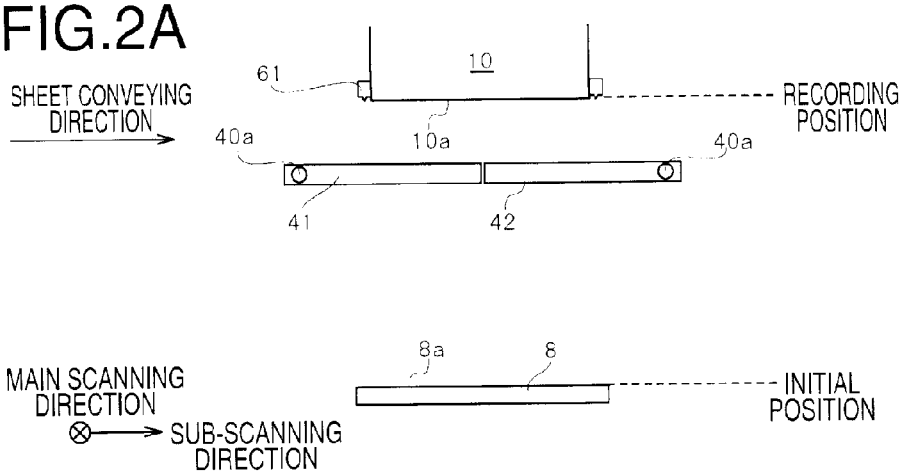
FIGS. 2A-2C illustrate behaviors of a platen and a liquid receiver in the inkjet printer according to the embodiment of the present invention.
Figure 2B:
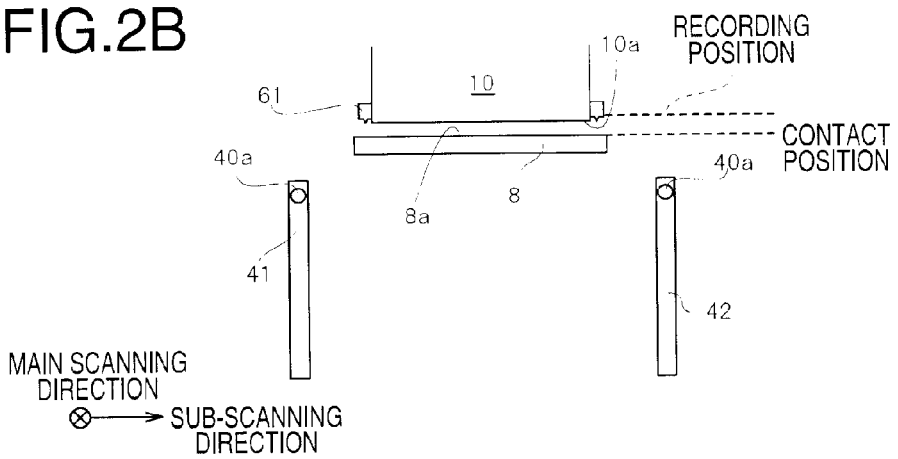

The initial position is a position, in which the liquid receiving surface 8*a* is separated from the ejection surface 10*a* (see FIG. 2A). When the liquid receiver 8 is placed in the initial position, the positional relationship between the ejection surface 10*a* of the inkjet head 10 being in the recording position and the liquid receiving surface 8*a* will be referred to as a second positional relationship. Image recording is conducted when the liquid receiver 8 is in the initial position.

Figure 2C:
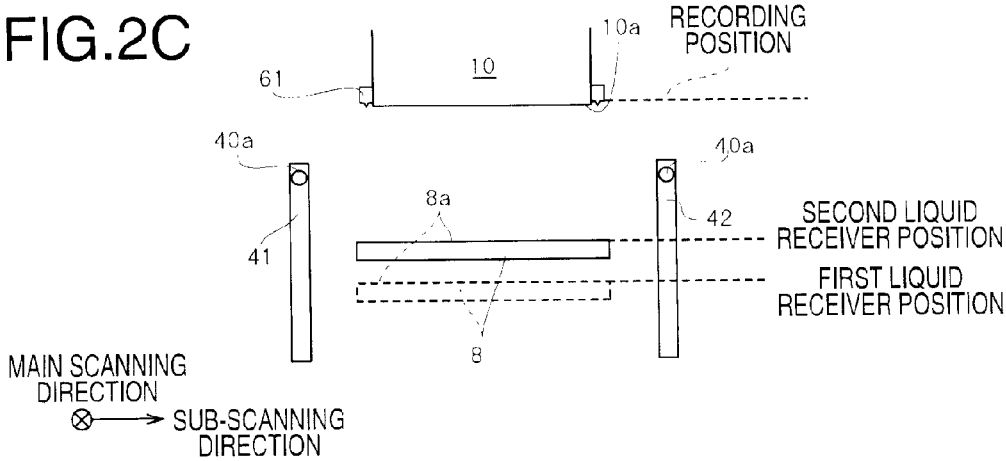

The first liquid receiving position and the second liquid receiving position are, as shown in FIG. 2C, in between the contact position and the initial position. When the liquid receiver 8 is placed in the first liquid receiving position, the liquid, receiving surface 8*a* is in a position slightly lower than a level of a lower end of the liquid receiving wiper 56*b* in the wiper unit 55. The head wiping action and the purging actions are conducted when the liquid receiver 8 is in the first liquid receiving position.

Meanwhile, when the liquid receiver 8 is placed in the second liquid receiving position, the liquid receiving surface 8*a* is in a position slightly higher than the lower end of the liquid receiving wiper 56*b* in the wiper unit 55. The liquid receiver wiping action is conducted when the liquid receiver 8 is in the second liquid receiving position.

Next, the inkjet head 10 will be described in detail with reference to FIGS. 4 and 5A-5B. In FIG. 5A, pressure chambers 110, apertures 112, and the nozzles 108, which are formed in positions underneath actuator units 21 and should be drawn in broken lines, are drawn in solid lines for reasons of expedience. As shown in FIG. 4, the inkjet head 10 is a laminated assembly including a fluid channel unit 9 and eight (8) actuator units 21 fixed on top of the fluid path unit 9. A lower surface of the fluid channel unit 9 is provided as the ejection surface 10*a*. In the fluid channel unit 9, ink channels are formed, and the actuator units 21 apply ejecting force to the ink flowing in the fluid channel unit 9.

As shown in FIG. 5B, the fluid channel unit 9 is a laminated assembly including nine (9) pieces of laminated stainless-made plates 122-130. On a top surface of the fluid channel unit 9, as shown in FIG. 1, eighteen (18) ink supply ports 105*b*, which is in communication with a reservoir unit (not shown), are formed. In the fluid channel unit 9, as shown in FIGS. 4 and 5A-5B, manifold channels 105 and auxiliary manifold channels 105*a* are formed. Each of the manifold channels 105 has the ink supply port 105*b* at one end, and is split into a plurality of auxiliary manifold channels 105*a* at the other end. Further, a plurality of individual ink channels 132 are formed. Each of the individual ink channels 132 connects an outlet of each auxiliary manifold channel 105*a* to the nozzle 108 through the pressure chamber 110. The plurality of nozzles 108 formed on the ejection surface 10*a* are arranged in matrix at density of, for example, 600 dpi, which corresponds to a resolution of the inkjet head 10 in the main scanning direction.

As shown in FIGS. 4 and 5A-5B, the ink supplied from the reservoir unit to the ink supply ports 105*b* are directed to the manifold channels 105 and to the auxiliary manifold channels 105*a*. The ink reaching the auxiliary manifold channels 105*a* is distributed to the individual ink channels 132 and delivered through the apertures 112 and the pressure chambers 110 to the nozzles 108.

As shown in FIG. 4, each of the eight actuator units 21 is formed to have a trapezoidal plane shape and is arranged alternately in the main scanning direction to avoid the ink supply ports 105*b*. Each actuator unit 21 is arranged to have two parallel sides thereof to align with the main scanning direction. Meanwhile, oblique sides of two adjoining actuator units 21 fit side-by-side to partially coincide with each other along the sub-scanning direction.

Next, the head holder 3 and the annular member 61 will be described with reference to FIGS. 4, 6, and 7A-7B. The head holder 3 is a frame made of for example, metal and holds the inkjet heads 10 at entire vertical sides. The annular member 61 is attached to the head holder 3 and is arranged around the vertical sides of the inkjet head 10 to surround, in a plane view, the outer periphery of the inkjet head 10. A pair of joints 81 are attached to the head holder 3. The head holder 3 and the inkjet head 10 are sealed to each other entirely by a sealer agent. Meanwhile, the head holder 3 and the annular member 61 are entirely fixed to each other by an adhesive agent.

The joints 81 are provided at one end and the other end of a flow path in the humidified air supplying unit 80. As shown in FIG. 6, the joints 81 include a right-side joint 81 with an air inlet 81*a* and a left-side joint 81 with an air outlet 81*b*, which are arranged on each side of the inkjet head 10 along the main scanning direction.

Each of the joints 81 is formed approximately in a cylindrical shape including a base part 81*x* and a top part 81*y* protruding from the base part 81*x*. The joint 81 is formed to have a column-shaped hollow 81*z*, which penetrates vertically through the base part 81*x* and the top part 81*y*. The base part 81*x* and the top part 81*y* are formed to have different outer diameters, and the outer diameter of the base part 81*x* is larger than the outer diameter of the top part 81*y*. Meanwhile, an inner diameter of the hollow 81*z* along the vertical direction is constant.

The head holder 3 is formed to have through-holes 3*a*, which are in a round shape in a plane view, and the joints 81 are fixed to the head holder 3 with the top parts 81*y* inserted in the through-holes 3*a*. The outer diameter of the top part 81*y* is smaller than an inner diameter of the through-hole 3*a*, but clearance between the top part 81*y* and the through-hole 3*a* is filled with a sealer agent.

The annular member 61 is formed in a rectangular shape, which is longer in the main scanning direction and shorter in the sub-scanning direction, in a plane view, and encircles the outer periphery of the inkjet head 10. The annular member 61 includes a resilient member 62, a movable member 63, and a plurality of gears 64. The resilient member 62 is supported by the head holder 3. The movable member 63 is movable upwardly and downwardly. The gears 64 are engaged with movable member 63.

The resilient member 62 is made of a resilient material such as rubber and is formed in a shape of a loop to encircle the inkjet head 10 in a plane view. The resilient member 62 includes, as shown in FIG. 7, a base 62*x*, a projection 62*a*, a fixed part 62*c*, and a connection part 62*d*. The projection 62*a* protrudes downward from a bottom of the base 62*x* and is formed to have a triangular cross section. The fixed part 62 is fixed to the head holder 3 and is formed to have a cross-sectional shape of "T." A top end of the fixed part 62*c* is fixed to the head holder 3 by an adhesive agent. The fixed part 62*c* is held between the head holder 3 and the base part 81*x* of the joint 81. The connection part 62*d* connects the base 62*x* with the fixed part 62*c*. The connection part 62*d* extends from a bottom of the fixed part 62*c* downward and to curve outward, in a direction to be away from the ejection surface 10*a* in a plane view, and is connected to a lower lateral side of the base 62*x*. The connection part 62*d* is deformable along with the movable member 63 being moved upwardly or downwardly. On an upper part of the base 62*x*, a dent 62*b* is formed to be engaged with a lower end of the movable member 63.

The movable member 63 is made of a rigid material such as stainless steel and is formed in a shape of a loop to encircle the inkjet head 10 in a plane view. The movable member 63 is supported by the resilient member 62 and is vertically movable with respect to the head holder 3. The movable member 63 is engaged with the gear 64, which can be rotated by rotation force generated in a lift motor 65 (see FIG. 8).

That is, under control of the control unit 100, as the lift motor 65 rotates, the gears 64 rotate, and the movable member 63 is uplifted or lowered. In this regard, the base 62*x* is uplifted or lowered along with the movable member 63. Therefore, the relative vertical position between the tip 61*a* of the annular member 61 (the projection 62*a*) and the ejection surface 10*a* changes.

The annular member 61 is selectively placed in one of a capping position (see FIG. 7A), in which the tip 61*a* contacts the liquid receiving surface 8*a* of the liquid receiver being in the contact position, a separated position (see FIG. 7B), in which the tip 61*a* is separated from the liquid receiving surface 8*a* of the liquid, receiver 8 being in the contact position, and an intermediate position see FIG. 6), which is in between the capping position and the separated position. When the annular member 61 is in the capping position, the ejection space S1 is enclosed by the annular member 61, the ejection surface 10*a*, and the liquid receiver 8 to be separated from the outer space S2. When in the separated position and the intermediate position, the ejection space S1 is in communication with the outer space S2.

Next, the humidified air supplying unit 80 will be described with reference to FIG. 6. The humidified air supplying unit 80 includes the pair of joints 81, a first humidifier pump 82 and a second humidifier pump 83, of which air-conveying capacities are adjustable, a tank 84, and tubes 85-89.

The tank 84 stores water in a lower part, a d air humidified by the water is stored in an upper part.

The tube 85 is connected to the top part 81*y* of the left-side joint at one end and to the first humidifier pump 82 at the other end. The tube 86 provides connection between the first humidifier pump 82 and the lower part of the tank 84 for communication. The tube 87 is connected to the right-side joint 81 at one end and to the upper part of the tank 81 at the other end. The tube 88 provides connection between the second humidifier pump 83 and the lower part 84 for communication. The tube 89 provides connection between the second humidifier pump 83 and the outer space S2 for communication.

The water in the tank 84 is prevented from flowing into the tubes 86, 88 by valves (not shown), which are arranged in the tubes 86, 88 respectively. Meanwhile, air is allowed to flow from the tubes 86, 88 to the tank 84 in directions indicated by arrows shown in FIG. 6.

With the configuration described above, when the regular humidifying action is conducted, under control of the control unit 100, the lift motor 65 is driven, and the tip 61*a* of the annular member 61 is placed in the capping position. Thus, the ejection space S1 is sealed from the outer space S2. Further, the first humidifier pump 82 is driven under control of the control unit 100. Thereby, the humidified air in the tank 84 is supplied to the ejection space S1 through the air inlet 81*a* and travels to fill the ejection space S1. Furthermore, the air in the ejection space S1 is drawn to be collected in the tank 84 through the air outlet 81*b*. Thus, in the regular humidifying action, the ink remaining in the vicinity of the nozzles 108 of the inkjet head 10 can be prevented from being dehydrated. Further, whilst the air is circulated between the ejection space S1 and the humidified air supplying unit 80, the once-humidified air can be recycled. Accordingly, an amount of the humidifying source (e.g., the water in the tank 84) to be consumed may be effectively reduced.

With the configuration described above, when the first liquid receiver cleaning action is conducted, under control of the control unit 100, the lift motor 65 is driven, and the tip 61*a* of the annular member 61 is placed in the intermediate position. Further, the first and second humidifier pumps 82, 83 are driven for a predetermined length of period under control of the control unit 100. Thereby, the humid air in the tank 84 is supplied, to the ejection space S1 through the air inlet 81*a* and travels to fill the ejection space S1. In this regard, apart of the humid air is released to the outer space S2 through the clearance between the tip 61*a* of the annular member 61 and the liquid receiving surface 8*a*. Meanwhile, the air in the ejection space S1 is drawn to be collected to the tank 84, and the air in the outer area 32 is drawn to flow to the tank 84. Thus, by the humid air supplied to the ejection space S1, viscosity of the ink adhered to the liquid receiving surface 8*a* is lowered. Thereafter, under control of the control unit 100, the liquid receiver wiping action is conducted. That is, the lift motor 65 is driven, and the ink adhered to the liquid receiving surface 8*a* is removed by the liquid receiver wiper 56*b*.

With the above-described first liquid receiver cleaning action, even when a larger amount of ink adheres to the liquid receiving surface 8*a*, the adhered ink can be effectively removed by the wiper unit 55. A total amount of the air to be conveyed in the first liquid receiver cleaning action by the first and second humidifier pumps 82, 83 in the predetermined time period is set to be greater than an amount of the air to be conveyed by the first humidifier pump 82 in the regular humidifying action. Therefore, in the first liquid receiver cleaning action, the viscosity of the ink adhered to the liquid receiving surface 8*a* can be effectively lowered. Further, an amount of the air to be conveyed by the first humidifier pump 82 in the first liquid receiver cleaning action is set to be lower than an amount of the air to be conveyed by the first humidifier pump 82 in the regular humidifying action. Therefore, with the smaller amount of the air to be collected through the air outlet 81*b*, the humid air in the ejection space S1 is released mostly through the clearance between the tip 61*a* of the annular member 61 and the liquid receiving surface 8*a* to the outer space S2. Accordingly, the liquid receiving surface 8*a* can be entirely exposed to the humid air, and the viscosity of the ink adhered to the liquid receiving surface 8*a* can be lowered evenly and effectively.

With the above-described configuration, when the second liquid receiver cleaning action is conducted, under control of the control unit 100, the lift motor 65 is driven, and the tip 61*a* of the annular member 61 is placed in the capping position. Thus, the ejection space S1 is sealed from the outer space S2. Further, the first humidifier pump 82 is driven under control of the control unit 100. Thereby, the humid air in the tank 84 is supplied to the ejection space S1 through the air inlet 81*a* and travels to fill the ejection space S1. Furthermore, the air in the ejection space S1 is drawn to be collected in the tank 84 through the air outlet 81*b*. Thus, by the humid air supplied to the ejection space S1, viscosity of the ink adhered to the liquid receiving surface 8*a* is lowered. Thereafter, under control of the control unit 100, the lift motor 65 is driven, and the tip 61*a* of the annular member 61 is placed in the separated position. Further, the wiper driving motor 59 is driven, and the ink adhered to the liquid receiving surface 8*a* is removed by the liquid receiver wiper 56*b*. Thus, even when the ink coagulates on the liquid receiving surface 8*a*, with the second liquid receiving surface cleaning action, the ink can be easily removed by the wiper unit 55. In the second liquid receiving surface cleaning action, an amount of the air to be conveyed by the first humidifying pump 82 is set to be greater than the amount of air conveyed by the first humidifier 82 in the regular humidifying action. Therefore, with the larger amount of the air to be supplied to the ejection space S1, the viscosity of the ink adhered to the liquid receiving surface 8*a* can be effectively lowered.

Next, the control unit 100 will be described with reference to FIG. 8. The control unit 100 includes a central processing unit (CPU), a read-only-memory (ROM), which stores programs to be executed by the CPU and data to be used. In the programs, a random access memory (RAM), which temporarily stores data for the programs, and a non-volatile memory (NVRAM), which are not shown. The control unit 100 consists of unit components, which include these hardware components and software components stored in the ROM functioning in cooperation with one another. More specifically; as shown in FIG. 8, the control unit 100 includes a conveyance controller 141, an image data storage 142, a head controller 143, a maintenance controller 144, a discharge action memory 145, a viscosity obtainment unit 146, and a cleaning necessity judgment unit 147.

The conveyance controller 141 controls behaviors of the feeder unit 1*c*, the guide unit 25, and the conveyer unit 30 to convey the sheet P along the sheet conveying direction in a predetermined speed based on a recording instruction transmitted from an external device. The image data memory 142 stores image data, which is included in the recording instructions transmitted from the external device. The head controller 143 manipulates the inkjet head 10 in an image recording operation to eject the ink toward the sheet P being conveyed based on the image data stored in the image data memory 142 or on print data which is converted from the image data.

The maintenance controller 144 manipulates the inkjet head 10, the liquid receiver moving unit 96, the head lifting unit 50, the platen motor 43, the pump 54, the lift motor 65, the first humidifier pump 82, and the second humidifier pump 83 during maintenance actions including the discharging action, the wiping action, and the regular humidifying action. Further, the maintenance controller 144 manipulates the liquid receiver moving unit 96, the head lifting unit 50, the platen motor 43, the lift motor 65, the first humidifier pump 82, and the second humidifier pump 83 to clean the liquid receiving surface 8*a* when the cleaning necessity judgment unit 147 determines that cleaning of the liquid receiving surface 8*a* is necessary.

The discharge action memory 145 stores information concerning time, in which the discharging action is conducted by the maintenance controller 144. The discharge action memory 145 is a non-volatile memory, which can maintain the stored information even after power failure occurs in the inkjet printer 1.

The viscosity obtainment unit 146 obtains information concerning the viscosity of the ink adhered to the liquid receiving surface 8*a* of the liquid receiver 8 by calculating a predictive value for the viscosity based on the times stored in the discharge action memory 145. More specifically the viscosity obtainment unit 146 stores elapsed time, which indicates a length of time period after receiving the ink by the liquid receiving surface 8*a* of the liquid receiver 8, and a formula defining the viscosity of the ink in relation with the elapsed time. With the formula, the viscosity obtainment unit 146 calculates the predictive value for the viscosity of the ink adhered to the liquid receiving surface 8*a* of the liquid receiver 8 based on the elapsed time since an earliest discharging action after the latest liquid receiver wiping action. Alternatively, the relation between the elapsed time since the capture of the discharged ink on the liquid receiving surface 8*a* of the liquid receiver 8 and viscosity of the ink may not necessarily be defined by a formula but may be defined by a data table.

The cleaning necessity judgment unit 147 judges whether the liquid receiving surface cleaning action is to be conducted. More specifically, the cleaning necessity judgment unit 147 judges that the first liquid receiver cleaning action is to be conducted when the information of the ink viscosity obtained by the viscosity obtainment unit 146 indicates a value greater than or equal to the first deuce of viscosity (see FIG. 3D), and when the amount of the ink adhered to the liquid receiving surface 8*a* detected by the liquid amount detecting sensor 90 indicates an amount greater than or equal to a predetermined amount. Further, the cleaning necessity judgment unit 147 judges that the second liquid receiver cleaning action is to be conducted when the information of the ink viscosity obtained by the viscosity obtainment unit 146 indicates a value greater than or equal to the second degree of viscosity, and when the amount of the ink adhered to the liquid receiving surface 8*a* detected by the liquid amount detecting sensor 90 indicates an amount smaller than the predetermined amount.

Next, a flow of steps included in the liquid receiver cleaning action will be described with reference to FIG. 9. The flow shown in FIG. 9 may start when power supply to the inkjet printer 1 is stopped during a purging action due to, for example, outage of electricity. Therefore, the ink adhered to the liquid receiving surface 8*a* of the liquid receiver 8 is left without being wiped. Meanwhile, the liquid receiver 8 is placed in the first liquid receiving position, and the inkjet head 10 is placed in the recording position.

When a user presses a power-on switch button (not shown) of the inkjet printer 1 to turn the electricity on, in step A1, the control unit 100 receives a power-on signal from the power-on switch. In A2, the viscosity obtainment unit 146 obtains information of the viscosity of the ink adhered to the liquid receiving surface 8*a* of the liquid receiver 8 based on the time of the discharging action stored in the discharge action memory 145. It may be noted that the discharge action memory 145 is a non-volatile memory, which can maintain the information concerning the time of the discharging action recorded before the electricity shutdown of the inkjet printer 1.

Next, in A3, the cleaning necessity judgment unit 147 judges whether either one of the first liquid receiver cleaning action and the second liquid receiver cleaning action is to be executed. If the cleaning necessity judgment unit 147 determines that either one of the first and the second liquid receiver cleaning actions is to be executed (A3: YES), in A4, the maintenance controller 144 controls the liquid receiver moving system 96 to move the liquid receiver 8 to the contact position. Thus, the ejection surface 10*a* and the liquid receiving surface 8*a* are placed to form the first positional relationship.

Next, in A5, if the cleaning necessity judgment unit 147 judges that the first liquid receiver cleaning action is to be conducted (A5: YES), in A6, the maintenance controller 144 controls the lift motor 65 to move the tip 61*a* of the annular member 61 to the intermediate position. Thereafter, in A7, the maintenance controller 144 drives the first humidifier pump 82 and the second humidifier pump 83 for a predetermine length of time. Whilst the tip 61*a* of the annular member 61 is placed in the intermediate position, the humid air can be delivered to the ink adhered to the liquid receiving surface 8*a* more effectively compared to the case in which the tip 61*a* of the annular member 61 is placed in the separated position. The predetermined length of time is as long as a period, which is required for the viscosity of the ink adhered to the liquid receiving surface 8*a* to be lowered at least to the viscosity at the maximum point in the curve of wiping efficiency (see FIG. 3D). Accordingly, the viscosity of the adhered ink may be effectively lowered. Further, the ink adhered to the liquid receiving surface 8*a* can be prevented from being transferred to the annular member 61. The flow proceeds to A10.

Meanwhile, if the cleaning necessity judgment unit 147 judges that the first liquid receiver cleaning action is not to be conducted but the second liquid receiver cleaning action is to be conducted (A5: NO), in A8, the maintenance controller 144 controls the lift motor 65 to move the tip 61*a* of the annular member 61 to the capping position. Thereafter, in A9, the maintenance controller 144 drives the first humidifier pump 82 alone for a predetermine length of time. Whilst the tip 61*a* of the annular member 61 is placed in the capping position, the humid air can be delivered to the ink adhered to the liquid receiving surface 8*a* effectively. The predetermined length of time is, similarly to the first liquid receiver cleaning action in A7, as long as a period, which is required for the viscosity of the ink adhered to the liquid receiving surface 8*a* to be lowered at least to the viscosity at the maximum point in the curve of wiping efficiency (see FIG. 3D). Accordingly, the viscosity of the adhered ink may be effectively lowered. In the second liquid receiver cleaning action, the tip 610 of the annular member 61 is placed in the capping position; however, the amount of the liquid adhered to the liquid receiving surface 8*a* is smaller than the predetermined amount. Therefore, although a smaller amount of the ink may be transferred to the annular member 61, the ink adhered to the liquid receiving surface 8*a* can be mostly prevented from being transferred to the annular member 61. The flow proceeds to A10.

In A10, the maintenance controller 144 controls the lift motor 65 to move the tip 61*a* of the annular member 61 to the separated position. Thereafter, in A11, the maintenance controller 144 drives the liquid receiver moving system 96 to move the liquid receiver 8 to the second liquid receiving position. Following A11, in A12, the maintenance controller 144 controls the wiper driving motor 59 to conduct the liquid receiver wiping action. More specifically, by controlling the base 56*c* to move rightward from the standby position, the liquid receiver wiper 56*b* being in contact with the liquid receiving surface 8*a* is moved in parallel with the liquid receiving surface 8*a* a to scrape the ink adhered to the liquid receiving surface 8*a* by the liquid, receiver wiper 56*b*. Thus, the ink adhered to the liquid receiving surface 8*a* is removed. In this regard, due to the effect of one of the aforementioned steps A7 and A9, the viscosity of the ink adhered to the liquid receiving surface 8*a* is lowered at least to the viscosity at the maximum point in the curve of the wiping efficiency. Thus, by the liquid receiver wiping action, the ink adhered to the liquid receiving surface 8*a* can be effectively and easily removed. Therefore, it can be prevented that the components in the ink adhered to the liquid receiver 8 may serve as dehydrating agents to dehumidify the air in the ejection space S1.

Meanwhile, in A3, if the cleaning necessity judgment unit 147 determines that neither of the first or the second liquid receiver cleaning action is to be executed (A3: NO), in A13, the maintenance controller 144 controls the liquid receiver moving system 96 to move the liquid receiver 8 to the second liquid receiving position. Thereafter, in A14, the maintenance controller 144 controls the wiper driving motor 59 to conduct the liquid receiver wiping action. More specifically, by controlling the base 56*c* to move rightward from the standby position, the liquid receiver wiper 56*b* being in contact with the liquid receiving surface 8*a* is moved in parallel with the liquid receiving surface 8*a* a to scrape the ink adhered to the liquid receiving surface 8*a* by the liquid receiver wiper 56*b*. Thus, the ink adhered to the liquid receiving surface 8*a* is removed. In this regard, the viscosity of the ink adhered to the liquid receiving surface 8*a* was smaller than the second degree of viscosity and the amount of the ink adhered to the liquid receiving surface 8*a* was smaller than the predetermined amount, or the viscosity of the ink adhered to the liquid receiving surface 8*a* was smaller than the first degree of viscosity. With the aforementioned humidifying, actions and the liquid receiver wiping action, the ink adhered to the liquid receiving surface 8*a* can be removed easily.

According to the inkjet printer 1 described above, when the viscosity of the ink adhered to the liquid receiving surface 8*a* is greater than or equal to the first degree of viscosity, and when the viscosity of the ink adhered to the liquid receiving surface 8*a* is greater than or equal to the second degree of viscosity and the amount of the adhered ink is smaller than the predetermined amount, the air in the ejection space S1 is humidified, and the viscosity of the adhered ink can be lowered. Accordingly, even once the ink coagulates tightly on the liquid receiving surface 8*a*, the ink can be easily removed by the wiper unit 55. Thus, if can be prevented that the components in the ink adhered to the liquid receiver 8 may serve as dehydrating agents to undesirably dehumidify the air in the ejection space S1.

Additionally, the air in the ejection space S1 may be humidified by a humidifier 180 having a heater 181 (see FIG.

10), which heats the lower part of the tank 84 under control of the maintenance controller 144. With the heater 181, air with higher humidity can be produced in the tank 84, and the highly humidified air can be supplied to the ejection space S1. Therefore, when the inkjet printer 1 is equipped with the heater 181, in the liquid receiver cleaning action, it is preferable that the heated temperature in the tank 84 is controlled to be higher during the liquid receiver cleaning action than a temperature in the tank 84 during the regular humidifying action. With the higher temperature, the air with higher humidity can be supplied to the ejection space S1 in the liquid receiver cleaning action, and the viscosity of the ink adhered to the liquid receiving surface 8*a* can be effectively lowered.

Although an example of carrying out the disclosure have been described, those skilled in the art will appreciate that there are numerous variations and permutations of the inkjet printer that fiat within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the positional relationship between the liquid receiving surface 8*a* and the ejection surface 10*a* may not necessarily be adjusted by the upward or downward movement of the liquid receiver 8. The positional relationship may be adjusted by, for example, moving the inkjet head 10 upwardly or downwardly, or by moving both of the liquid receiver 8 and the inkjet head 10.

For another example, the liquid receiving surface 8*a* may not necessarily be in the posture to face the ejection surface 10 at all time (during the recording action, across the platen 40). The liquid receiving surface 8*a* may be placed in a posture not to face the ejection surface 10*a* when the liquid receiver 8 is in the initial position.

For another example, the relative vertical position between the tip 61*a* of the annular member 61 (the projection 62*a*) and the ejection surface 10*a* may not necessarily be changed but may be fixed as long as the tip 61*a* of the annular member 61 is in contact with the liquid receiver 8 when the ejection surface 10*a* and the liquid receiving surface 8*a* are in the first positional relationship.

For another example, the amount of the ink adhered to the liquid receiving surface 8*a* may not necessarily be detected by the optical liquid amount detecting sensor 90. For example, an amount of the ink ejected from the nozzles 108 during the discharging action may be detected, and the ejected amount may be considered as the amount of the ink adhered to the liquid receiving surface 8*a*. In this case, it is preferable that the amount of the ink ejected during the discharging action may be stored in a non-volatile memory.

For another example, the ink adhered to the liquid receiving surface 8*a* may not necessarily be removed by wiping but may be removed by vacuuming.

For another example, the viscosity of the ink adhered to the liquid receiving surface 8*a* may not necessarily be calculated solely based on the elapsed time since the receiving of the discharged ink on the liquid receiving surface 8*a*. For example, the inkjet printer 1 may be equipped with a temperature sensor and a humidity sensor, and the viscosity of the adhered ink may be calculated based on the temperature and the humidity within the chassis 1*a* in addition to the elapsed time, in this case, more accurate viscosity of the adhered ink may be achieved. Further, the information concerning the viscosity obtained by the viscosity obtainment unit 146 may not necessarily be the predictive value but may be an actually observed value, which can be observed through a viscometer.

For another example, the shapes and positions of the air inlet 81*a* and the air outlet 81*b* may not be limited as long as the air inlet and the air outlet are in communication with the ejection space S1. For example, the air inlet may be formed on the ejection surface 10*a*, and the air outlet may be formed on the joint 81 of the head holder 3.

The present invention may be applied to both line-typed and serial-typed inkjet printers. Further, the present invention may not necessarily be applied to a printer but may similarly be applied to, for example, a facsimile machine and a copier. Furthermore, the liquid to be ejected may not necessarily be limited to ink, but the present invention may be applied to other liquid-ejecting devices capable of recording images by ejecting liquid, which is other than ink. Moreover, the present invention may be applied to such liquid ejecting devices regardless of liquid-ejecting methods thereof.

What is claimed is:

1. A liquid ejecting device, comprising:

a liquid ejecting head comprising an ejection surface on which an ejection opening for ejecting liquid is formed;

a liquid receiving member comprising a liquid receiving surface on which the liquid ejected from the ejection opening is received;

an annular member arranged around the liquid ejecting head and configured to seal an ejection space to which the ejection surface is opposed from an outer space with the liquid receiving surface;

a positional relationship adjusting unit configured to adjust a positional relationship between the ejection surface and the liquid receiving surface by moving at least one of the liquid ejecting head and the liquid receiving member to form one of a first positional relationship in which the annular member is able to contact the liquid receiving member to seal the ejection space from the outer space and a second positional relationship in which the liquid receiving surface and the ejection surface are separated farther from each other than the liquid receiving surface and the ejection surface in the first positional relationship;

an air inlet communicated with the ejection space;

a humidified air supplying unit configured to supply humidified air to the ejection space through the air inlet;

a cleaning unit configured to clean the liquid receiving surface by removing the liquid received on the liquid receiving surface;

a viscosity information obtainment unit configured to obtain information concerning viscosity of the liquid received on the liquid receiving surface; and a control unit configured to conduct a liquid receiving surface cleaning action, when the information concerning viscosity of the liquid obtained by the viscosity information obtainment unit indicates at least a predetermined degree of viscosity, the liquid receiving surface cleaning action comprising:

controlling the positional relationship adjusting unit so as to adjust the positional relationship between the ejection surface and the liquid receiving surface to form the first positional relationship;

controlling the humidified air supplying unit so as to supply the humidified air to the ejection space for a predetermined time; and controlling the cleaning unit so as to remove the liquid received on the liquid receiving surface.

2. The liquid ejecting device according to claim 1, further comprising:

an annular member moving unit configured to move the annular member, when the positional relationship between the ejection surface and the liquid receiving surface forms the first positional relationship, between a contact position in which the annular member contacts the liquid receiver and a separated position in which the annular member is separated from the liquid receiving member, wherein the liquid receiving surface cleaning action further comprises:

controlling the annular member moving unit such that a clearance between the annular member and the liquid receiving member becomes a predetermined amount of clearance; and controlling the humidified air supplying unit to supply the humidified air to the ejection space for the predetermined time.

3. The liquid ejecting device according to claim 1, further comprising:

an annular member moving unit configured to move the annular member, when the positional relationship between the ejection surface and the liquid receiving surface forms the first positional relationship, between a contact position in which the annular member contacts the liquid receiving member and a separated position in which the annular member is separated from the liquid receiving unit, wherein the liquid receiving surface cleaning action further comprises:

controlling the annular member moving unit to move the annular member to contact the liquid receiving member; and controlling the humidified air supplying unit to supply the humidified air to the ejection space for the predetermined time.

4. The liquid ejecting device according to claim 1, wherein the control unit is configured to conduct a regular humidifying action, which is different from the liquid receiving surface cleaning action, and in which the humidified air is supplied to the ejection space sealed from the outer space; and wherein the control unit controls the humidified air supplying unit to supply one of a greater amount of humidified air to the ejection space than an amount of humidified air to be supplied to the ejection space in the regular humidifying action and air with higher humidity than the air to be supplied to the ejection space in the regular humidifying action.

5. The liquid ejecting device according to claim 1, further comprising:

an air outlet formed in an area which is communicated with the ejection space, wherein the humidified air supplying unit is configured to collect air through the air outlet, humidify the collected air, and supply the collected and humidified air to the ejection space through the air inlet; and wherein the control unit controls, in the liquid receiving surface cleaning action, the humidified air supplying unit to collect a smaller amount of air through the air outlet in the predetermined time than an amount of the air to be collected in the predetermined length of time through the air outlet in the regular humidifying action.

6. The liquid ejecting device according to claim 1, further comprising:

a liquid amount detecting unit configured to detect an amount of the liquid received on the liquid receiving surface, wherein the control unit conducts the liquid, receiving surface cleaning action when the detected amount of the liquid received on the liquid receiving surface detected by the liquid amount detecting unit is at least a predetermined amount.

7. The liquid ejecting device according to claim 1, wherein the viscosity information is defined on basis of a time period elapsed after latest receiving of the liquid ejected from the ejection opening on the liquid receiving surface.

8. The liquid ejecting device according to claim 1, further comprising:

an annular member moving unit configured to move the annular member, when the positional relationship between the ejection surface and the liquid receiving surface forms the first positional relationship, between a contact position in which the annular member contacts the liquid received member and a separated position in which the annular member is separated from the liquid receiving member, wherein the liquid receiving surface cleaning action further comprises:

controlling the annular member moving unit to move the annular member apart from the liquid receiving member; and controlling the humidified air supplying unit to supply the humidified air to the ejection space for the predetermined time.

9. The liquid ejecting device according to claim 1, wherein the control unit comprises the viscosity information obtainment unit.

* * * * *